United States Patent [19]

McGaw

[11] 4,419,565

[45] Dec. 6, 1983

[54] TWO-MODE STEAM BRUSH CURLER

[75] Inventor: John McGaw, Markham, Canada

[73] Assignee: Appliance Design Probe Inc., Scarborough, Canada

[21] Appl. No.: 65,464

[22] Filed: Aug. 10, 1979

[51] Int. Cl.[3] ..... A45D 1/02; A46B 15/00; A46B 7/10; H05B 3/02

[52] U.S. Cl. ..... 219/222; 15/27; 15/202; 132/11 R; 132/33 R; 132/34 R; 132/85; 132/118; 132/122; 132/150; 219/244; 219/274; 219/533

[58] Field of Search ..... 219/222–226, 219/244, 273, 274, 533, 230; 132/7, 9, 11 R, 11 A, 33 R, 34 R, 34 A, 34 B, 37 R, 37 A, 112, 116, 117, 118, 85; 15/202, 24, 27

[56] References Cited

U.S. PATENT DOCUMENTS

| | | | |
|---|---|---|---|
| 1,357,354 | 11/1920 | Simon | 15/24 |
| 1,685,328 | 9/1928 | Kogler et al. | 15/202 |
| 3,533,421 | 10/1970 | Mays | 132/34 R |
| 3,814,113 | 6/1974 | Morane | 132/36 R |
| 3,922,521 | 11/1975 | Viegut et al. | 219/222 |
| 3,934,597 | 1/1976 | McNair | 132/9 X |
| 3,947,910 | 4/1976 | Akerman | 132/34 R |
| 3,973,528 | 8/1976 | Walter et al. | 132/11 R |
| 4,024,375 | 5/1977 | Olesen et al. | 132/34 R |
| 4,029,110 | 6/1977 | Hyland | 219/222 X |
| 4,032,747 | 6/1977 | Kunz | 132/37 R |
| 4,192,328 | 3/1980 | Barradas et al. | 132/37 R |
| 4,197,608 | 4/1980 | Holley et al. | 15/27 |
| 4,209,685 | 6/1980 | Walter et al. | 219/225 |
| 4,314,137 | 2/1982 | Dorn | 219/222 |
| 4,326,545 | 4/1982 | Motegi et al. | 132/33 R |

FOREIGN PATENT DOCUMENTS

| | | | |
|---|---|---|---|
| 867075 | 5/1978 | Belgium | 219/222 |
| 515063 | 12/1930 | Fed. Rep. of Germany | 219/222 |
| 52-20168 | 2/1977 | Japan | 132/9 |
| 52-64344 | 5/1977 | Japan | 219/222 |
| 1548540 | 7/1979 | United Kingdom | 219/222 |

*Primary Examiner*—A. Bartis
*Attorney, Agent, or Firm*—Sim & McBurney

[57] ABSTRACT

A hand-held steam hair curler-brush includes a perforated open-ended metallic cylinder extending forwardly from a handle. Secured to the handle and extending into the interior of the cylinder is a cylindrical member containing an electric heating element and having a closed end remote from the handle and a side wall spaced from the interior of the cylinder to define a first annular space therebetween. A rotatable perforated cylindrical barrel surrounds the cylinder and is spaced therefrom by first and second supports at the ends of the cylinder to define a second annular space therebetween. The support at the end of the cylinder remote from the handle includes a manually actuatable steam producing means closing the open end of the cylinder and arranged to create steam in the first annular space by bringing water into contact with the heated closed end of the cylindrical member. The steam flows into the second annular space through the perforations in the cylinder and is distributed to the hair being curled by the perforations in the barrel. The barrel is provided with removable rows of radially outwardly extending resilient projections defining a hair brush and the handle has a releasable lock mechanism for locking the barrel against rotation about the cylinder.

6 Claims, 3 Drawing Figures

TWO-MODE STEAM BRUSH CURLER

This invention relates to hand-held steam curlers, and has to do particularly with a hand-held steam curler in which the cylindrical barrel element which contacts and curls the hair of the user may be either locked in position with respect to the handle or permitted to rotate with respect thereto, depending upon the wish of the user.

GENERAL DESCRIPTION OF THIS INVENTION

Accordingly, this invention provides a hand-held steam curler which includes a handle, and a hollow, openended, perforated, metallic cylinder extending forwardly from the handle and fixed with respect to the handle. Inside the cylinder is a hollow metallic cylindrical member which is fixedly mounted, and which has a closed end remote from the handle and an open end proximate to the handle. The cylindrical member is spaced uniformly inwardly from the cylinder adjacent the perforations of the latter, to define a first annular space therebetween. Inside the cylindrical member is a heating element. A rotatable, non-removable barrel of cylindrical form surrounds the cylinder and is spaced uniformly outwardly therefrom to define a second annular space. A first means is mounted on the end of the cylinder remote from the handle to maintain one end of the barrel uniformly spaced from the cylinder while the barrel rotates. The first means includes steam-producing means capable of producing steam by bringing water into contact with the closed end of the cylindrical member. A second means is also provided, proximate to the handle and fixed with respect thereto. The second means maintains the other end of the barrel uniformly spaced from the cylinder while the barrel rotates. Finally, locking means is provided for selectively locking and releasing the barrel with respect to the handle and metallic cylinder.

GENERAL DESCRIPTION OF THE DRAWINGS

DETAILED DESCRIPTION OF THE DRAWINGS

Figures 1, 2, 3:
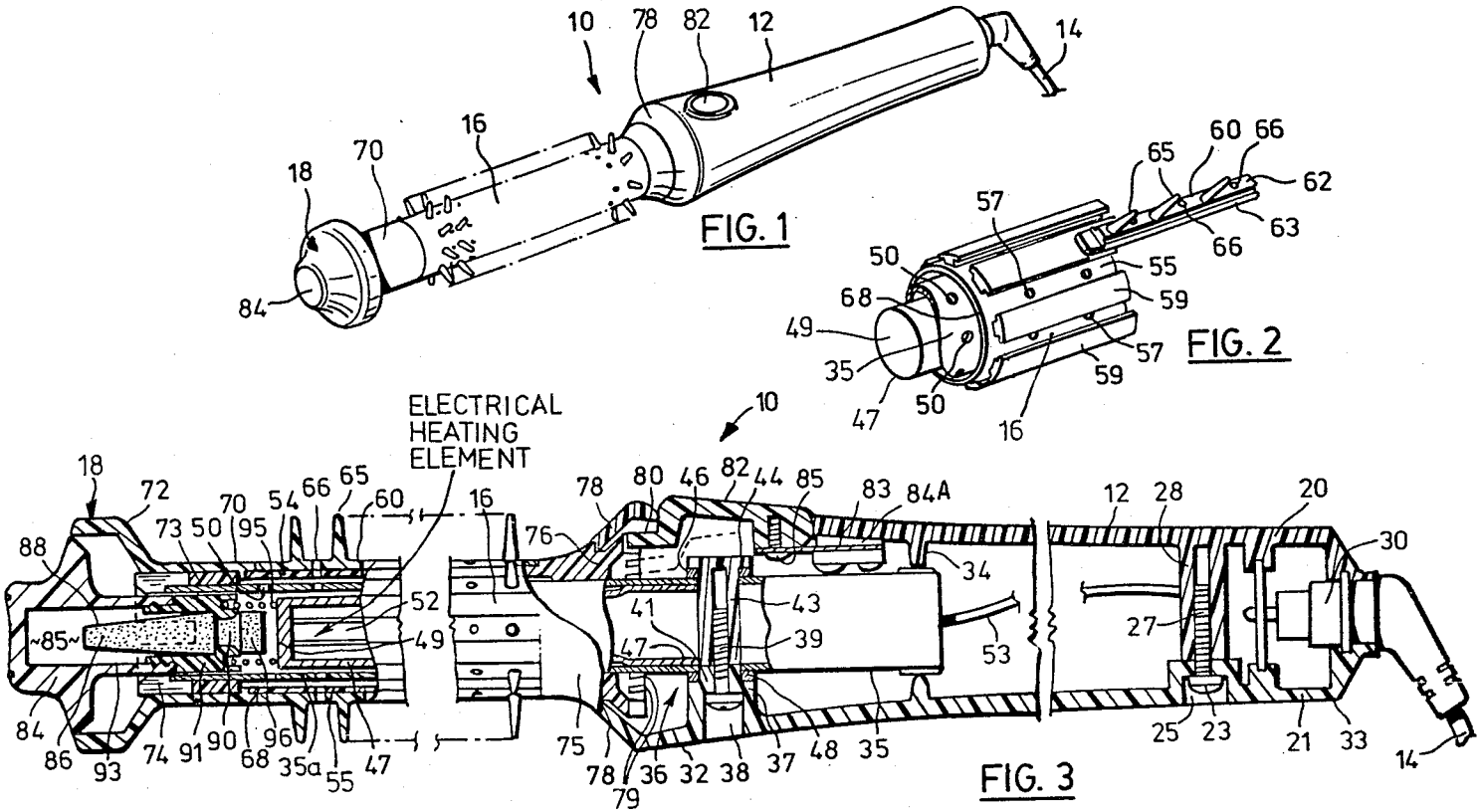
FIG. 1 is a perspective view of a hand-held steam curler constructed in accordance with this invention.
FIG. 2 is a partial perspective view, partially broken away, of the steam curler of FIG. 1.
FIG. 3 is a partly sectional and partly elevational view along the longitudinal axis of the steam curler of FIG. 1.

Turning first to FIG. 1, a hand-held steam curler 10 is seen to include a handle 12, an electric wire 14 to provide power to the device, a rotatable barrel 16, and a stationary tip 18.

Attention is now directed to FIG. 3.

The handle 12, in accordance with standard constructional methods, is composed of two parts 20 and 21, these being secured together by means of a metal bolt 23, the head of which is located in a recess 25 defined in part 21. The shank 27 of the bolt 23 is threaded into a boss 28 integral with and extending downwardly from the part 20 of the handle 12. Again in accordance with standard methods of construction, a swivel attachment 30 for the electric wire 14 is provided, and means (not shown) are included which allow the wire 14 to be swivelled with respect to the handle 12, without tangling or breaking the internal wires in the handle 12. These portions are not shown, because they play no part in the present invention.

As can be seen, the handle 12 shown in the figures and forming part of the specific embodiment illustrated is generally cylindrical in form, although it is slightly "horn" shaped, with a larger leftward or forward end 32 and a smaller rearward end 33.

Provided within the larger forward end 32 of the handle 12 is an annular brace member 34, which surrounds and firmly grips the rightward end of a hollow, open-ended, metallic cylinder 35, which is perforated in its forward or leftward region 35*a*, for reasons which will appear subsequently. The cylinder 35 is firmly fixed with respect to the handle 12 by virtue of the cooperation between the annular member 34 and a construction shown generally at 36, which includes a boss 37 on the lower part 21 of the handle 12, the boss 37 defining a recess 38 into which is received the head of a bolt 39. The boss 37 defines a projecting portion 41 surrounding the shank of the bolt 39, the projecting portion 41 being received within a similarly sized opening in the wall of the metallic cylinder 35 as depicted in FIG. 3. An identical opening is located antipodally of the first-mentioned opening in the wall of the metallic cylinder 35, and through this further opening is received a tubular member 43 having a central bore into which is threaded the shank of the bolt 39. The tubular member 43 defines a portion 44 of larger diameter remote from the bolt 39, and a resilient ring 46 is located between the portion 44 of larger diameter and the outer surface of the cylindrical member 35. Similarly, a further resilient ring 48 is located between the boss 37 and the outer surface of the metallic cylinder 35. By appropriately sizing the tubular member 43, the metallic cylinder 35 can be firmly retained in place by tightening up the bolt 39 in the condition shown in FIG. 3. Thus the metallic cylinder 35 is held at two longitudinally spaced-apart locations with respect to the handle 12, and is thus securely fixed.

Within the said metallic cylinder 35 is located a hollow, metallic cylindrical member 47. The cylindrical member 47 is fixedly mounted with respect to the metallic cylinder 35, and has a closed end 49 remote from the handle 12, and an open end proximate to the handle 12 (seen abutting the tubular member 43 in FIG. 3).

More specifically, the cylindrical member 47 has its leftward end of smaller outer diameter than the inner diameter of the member 35, such that the member 47, at its leftward end, is spaced inwardly from the cylinder 35 adjacent the perforations 50 of the latter (see also FIG. 2). The cylindrical member 47, at its end proximate to the handle 12 has a portion of enlarged diameter which is a tight fit with the cylinder 35.

Thus the spacing between the member 47 and the cylinder 35 at the leftward end defines an annular space therebetween, the purpose of which will become clear presently.

A heating element 52 of conventional construction is located within the cylindrical member 47 and is provided with electrical power through the wire 14, and through an internal electrical wire 53.

Mounted for free rotation about the common axes of the member 47 and the cylinder 35 (by means which will be described below), is a rotatable barrel 16, which is best seen in FIG. 2. The rotatable barrel 16 consists of a base cylinder 55 containing lines of perforations 57 aligned with the axis of the base cylinder 55. The base cylinder 55 further includes a plurality of outwardly projecting, longitudinally aligned, T-shaped projections 59, located between the lines of perforations 57. Between each pair of adjacent projections 59 can be slid a resilient fingerbearing insert 60, which includes a base 62 with side ledges 63 adapted to be received under the overhang of the appropriate projection 59, as well as radially outwardly extending projections 65. Between the projections 65 are located perforations 66, adapted to be aligned with the perforations 57 in the base cylinder 55. Thus, when a plurality of inserts 60 are in position between all pairs of adjacent projections 59, with the perforations 60 aligned with the perforations 57, the arrangement shown in FIG. 3 is attained. In FIG. 3, the appropriate parts bear numerals identical to those used with respect to FIG. 2.

It will be noted in FIG. 2 that the projections 59 do not extend all the way to the leftward end of the base cylinder 55, but instead a marginal portion 68 remains. This marginal portion 68 is adapted to lodge loosely but in a contained fashion under a ledge 70 on a support means 72 forming part of the tip 18 seen in FIG. 1.

The support means is radially symmetrical about the axis of the cylinder 35, and is firmly fixed with respect thereto by virtue of the presence of a resilient collar 73 which lies between them, and which is sized to provide a tight force-fit between these elements. The collar 73 is slotted at its leftward end as shown by the numeral 74, and the remaining portions between the slots are keyed to grip the leftward end of the cylinder 35.

Because the marginal portion 68 of the base cylinder 55 lies under the ledge 70, although loosely so, rotation of the barrel is not impeded by this restraint.

At its rightward end, the barrel 16 widens at 75 and defines a cut-back portion 76 which cooperates with a support portion 78 forming part of the handle, in order to retain the barrel 16 longitudinally in position with respect to the handle 12, but also to allow the barrel 16 to rotate with respect to the handle 12. The rightward end of the barrel, where it is located within the handle 12, is shaped to define keys having slots 79 between them, and these keys are adapted to interfere mechanically with a finger 80 which projects leftwardly from and is integral with a manually depressible button member 82. The button member 82 is available through an opening in the upper part 20 of the handle 12, and moreover is attached thereto and biased outwardly by virtue of a metallic spring member 83, which is secured with respect to the handle 12 at 84A, and with respect to the buttom member 82 by a metallic bolt 85. By virtue of the spring-like metallic member 83, the button member 82 can be moved inwardly and outwardly in order to move the projecting finger 80 manually either toward the axis of the cylindrical member 47 or away from it. When the projecting finger 80 is in the outermost position, shown in solid lines in FIG. 3, mechanical interference exists between slots 79 between the keys at the rightward end of the barrel 16 and the finger 80, such that rotation of the barrel 16 is impeded. However, when the button member 82 is depressed inwardly against the resiient urging of the metallic member 83, thereby carrying the projecting finger 80 down to the position shown in broken lines in FIG. 3, no mechanical interference takes place, and the barrel is thus permitted to rotate.

The tip 18 further includes, in addition to the support member 72, steam-producing means capable of producing steam by bringing water into contact with the closed end 49 of the cylindrical member 47. This steam-producing means includes a radially symmetrical member 84 which is connected to the support member 72 by a living hinge, and which defines a water compartment 85 into which extends one end 86 of a sponge member 88 adapted to take up and retain water from the compartment 85. The sponge member 88 has a portion 90 of reduced diameter which is captured in a collar 91 that is snap fitted into a rightwardly projecting cylindrical extension 93 of the member 84 at its leftward end, and which has an annular recess adapted to receive the leftward end of a coil compression spring 95, the rightward end of which bears directly against the end face 49 of the member 47. Thus, the compression coil spring 95 constitutes resilient means biasing the water impregnatable sponge member 88 away from the closed end 49, while finger pressure in the rightward direction against the leftward end of the member 84 will urge a contact portion 96 of the sponge member 88 into contact with the end wall 49, thus producing a suddent burst of steam due to the fact that the end wall 49 is maintained above the boiling point of water by the heating element 52. This sudden burst of steam passes along the annular space defined between the leftward end of the member 47 and the leftward perforated end of the cylinder 35, thus gaining access to the perforations 50 in the cylinder 35. After passing through the perforations 50, the steam is again distributed through the annular space existing between the base cylinder 55 and the metallic cylinder 35, to gain access to the perforations 57 and 66. The steam thus comes out and contacts the hair of the user which is wound around the barrel 16 at the time.

It is considered of importance that the base cylinder 55 and its projections 59, the metallic cylinder 35 and the cylindrical member 47 all be of metal, preferably a metal of high heat conductivity such as aluminum. This will allow a faster and more direct conductivity of the heat from the heating element 52 directly to the hair of the user. The construction of the base cylinder 55 and the inserts 60, in combination, allows the achievement of two simultaneous advantages, namely the high heat conductivity of the metallic base cylinder 55, coupled with the resilience of the fingers 65 in the resilient inserts 60.

Other than the specific metallic components just named, all other parts of the steam curler (aside from connecting members and electrical portions) are of heat resistant plastic.

I claim:

1. A hand-held steam curler for hair, comprising:

a handle, a hollow, open-ended, perforated, metallic cylinder extending forwardly from said handle and fixed with respect thereto, a hollow metallic cylindrical member fixedly mounted within said cylinder and having a closed end remote from said handle and an open end proximate to said handle, said member being spaced uniformly inwardly from the said cylinder adjacent the perforations of the latter, to define a first annular space therebetween, a heating element within said cylindrical member for heating the side wall and end wall thereof, a rotatable, perforated barrel of cylindrical form surrounding said cylinder and spaced uniformly outwardly therefrom to define a second annular space, communicating with said first annular space through said perforations in the cylinder, the barrel being restrained against axial movement and defining a mandrel for contacting the hair to be treated, first means mounted on the end of the cylinder remote from the handle to maintain one end of the barrel uniformly spaced from the cylinder while permitting barrel rotation, said first means including selectively operable steam-producing means closing the end of said cylinder remote from said handle and capable of producing steam in said first annular space by bringing water into contact with the closed end of said cylindrical member, second means proximate to said handle and fixed with respect thereto, for maintaining the other end of the barrel uniformly spaced from the cylinder while the barrel rotates, and manual locking means on said handle and barrel for selectively cooperable locking and releasing of the barrel with respect to the handle and metallic cylinder.

2. The invention claimed in claim 1, in which the second means is integral with the handle, and in which the cylindrical member has an enlarged portion proximate to said handle, which portion is in a tight fit with said cylinder.

3. The invention claimed in claim 1 or claim 2, in which the rotatable barrel has radially outwardly extending, removable, resilient projections at uniform intervals longitudinally and circumferentially thereof.

4. The invention claimed in claim 1, in which the steam-producing means includes a water compartment, a water-impregnatable portion adapted to be urged against said closed end and in communication with said compartment, resilient means biasing the water-impregnatable portion away from the said closed end, and finger-actuatable means for urging said water-impregnatable portion toward and against said closed end.

5. The invention claimed in claim 1, in which said locking means includes resilient biasing means urging the cooperating locking means toward a condition in which the barrel is locked with respect to the handle and metallic cylinder.

6. The invention claimed in claim 5, in which said locking means includes a member mounted on said handle and having a projecting finger which is movable manually toward and away from the axis of the said cylindrical member, and in which said other end of the barrel is shaped to define a plurality of slots between a plurality of keys that interefere mechanically with said finger when the latter is manually moved away from said axis, thus impeding rotation of the barrel, and that fail so to interfere when the finger is manually moved toward said axis, thus permitting rotation of the barrel.

* * * * *